US012612213B2

(12) United States Patent
Wei

(10) Patent No.: US 12,612,213 B2
(45) Date of Patent: Apr. 28, 2026

(54) CONTAINER SEALING BODY

(71) Applicant: SEAL AND PACK CO., LTD, Icheon-si (KR)

(72) Inventor: Se Hwang Wei, Yongin-si (KR)

(73) Assignee: SEAL AND PACK CO., LTD, Icheon-si (KR)

( * ) Notice: Subject to any disclaimer, the term of this patent is extended or adjusted under 35 U.S.C. 154(b) by 951 days.

(21) Appl. No.: 17/251,928

(22) PCT Filed: Jun. 20, 2019

(86) PCT No.: PCT/KR2019/007417
§ 371 (c)(1),
(2) Date: Dec. 14, 2020

(87) PCT Pub. No.: WO2020/009354
PCT Pub. Date: Jan. 9, 2020

(65) Prior Publication Data

US 2021/0261291 A1 Aug. 26, 2021

(30) Foreign Application Priority Data

Jul. 3, 2018 (KR) ..... 10-2018-0076967

(51) Int. Cl.
*B65D 17/50* (2006.01)

(52) U.S. Cl.
CPC .... *B65D 17/502* (2013.01); *B65D 2517/5013* (2013.01); *B65D 2517/5021* (2013.01);
(Continued)

(58) Field of Classification Search
CPC ..... B65D 17/502; B65D 2517/5013; B65D 2517/5021; B65D 2517/5024;
(Continued)

(56) References Cited

U.S. PATENT DOCUMENTS 4,087,018 A * 5/1978 Tebbutt ..... B65D 53/02 220/270
4,892,227 A 1/1990 MacLaughlin
(Continued)

FOREIGN PATENT DOCUMENTS

AU 2014367585 4/2018
CN 104755388 7/2015
(Continued)

OTHER PUBLICATIONS

SIPO, Office Action of CN 201980043633.1 dated Jan. 30, 2022.
(Continued)

*Primary Examiner* — Don M Anderson
*Assistant Examiner* — John Martin Hoppmann
(74) *Attorney, Agent, or Firm* — LEX IP MEISTER, PLLC

(57) ABSTRACT

Disclosed is a container sealing body applied to seal an inlet of a container, the container sealing body including: an upper layer; a lower layer provided below the upper layer; and a thermal bonding resin layer configured between the upper layer and the lower layer and thermally bonded by thermal bonding resin, in which the upper layer includes: a surface layer provided for printing and configured to prevent thermal bonding; and a synthetic resin layer having tensile strength and hardness and configured sequentially with the surface layer from above to below, an opening tab is configured by cutting and punching the upper layer, an opening initiation guide cutting line is formed at one side of the opening tab, the lower layer includes a blocking layer for preventing transmission of oxygen or moisture, and a thermal bonding sealing layer, and the synthetic resin layer of the upper layer and the blocking layer of the lower layer are bonded.

19 Claims, 17 Drawing Sheets

(52) U.S. Cl.
CPC ..... *B65D 2517/5024* (2013.01); *B65D 2517/5083* (2013.01)

(58) Field of Classification Search
CPC ..... B65D 2517/5083; B65D 2577/205; B65D 2577/2091; B65D 77/2056; B65D 51/20; B65D 51/228; B65D 53/04; B65D 2251/0093; B65D 2251/0096; B65D 2543/00833; B65D 2517/0013; B65D 2251/0015; B65D 77/2044; B32B 2250/44; B32B 2266/025; B32B 2307/31; B32B 2307/4023; B32B 2307/412; B32B 2307/518; B32B 2307/536; B32B 2307/54; B32B 2307/558; B32B 2307/56; B32B 2307/582; B32B 2307/7244; B32B 2307/7265; B32B 2307/732; B32B 2307/748; B32B 2439/60; B32B 2439/66; B32B 2581/00; B32B 1/02; B32B 3/08; B32B 3/26; B32B 5/18; B32B 7/05; B32B 7/12; B32B 15/08; B32B 15/20; B32B 27/08; B32B 27/283; B32B 27/306; B32B 27/308; B32B 27/32; B32B 27/36; B32B 27/365; B32B 27/40
USPC ..... 220/359.1, 3, 260, 266, 269, 793, 347, 220/232, 349, 305, 250, 257, 255, 359.3, 220/276, 359.4; 215/298; D9/438
See application file for complete search history.

(56) References Cited

U.S. PATENT DOCUMENTS

| | | | | |
|---|---|---|---|---|
| 4,913,307 | A | 4/1990 | Takata et al. | |
| 4,960,216 | A * | 10/1990 | Giles | B65D 51/20 220/258.2 |
| 5,069,355 | A | 12/1991 | Matuszak | |
| 5,265,745 | A | 11/1993 | Pereyra et al. | |
| 5,353,943 | A | 10/1994 | Hayward | |
| 6,056,141 | A * | 5/2000 | Navarini | B65D 77/2044 428/35.8 |
| 6,360,909 | B1 | 3/2002 | Bridge | |
| 2006/0054584 | A1* | 3/2006 | Jackman | B65D 51/20 215/347 |
| 2008/0233339 | A1* | 9/2008 | Thorstensen-Woll | B65D 51/20 428/99 |
| 2014/0224800 | A1* | 8/2014 | Thorstensen-Woll | G09F 3/0341 220/255 |
| 2015/0034647 | A1 | 2/2015 | Ban et al. | |
| 2016/0332771 | A1* | 11/2016 | Wei | B65D 51/245 |

FOREIGN PATENT DOCUMENTS

| | | | | |
|---|---|---|---|---|
| CN | 107531360 | | 1/2018 | |
| EP | 2620387 | | 3/2014 | |
| EP | 2886485 | | 6/2015 | |
| JP | S58-145835 | | 9/1983 | |
| JP | H01182245 | | 7/1989 | |
| JP | 2001-031129 | | 2/2001 | |
| JP | 2008-526633 | | 7/2008 | |
| JP | 2015-101347 | | 6/2015 | |
| JP | 60-18364 | | 11/2016 | |
| JP | 2017-507848 | | 3/2017 | |
| JP | 2018-030321 | | 3/2018 | |
| KR | 10-0886955 | | 3/2009 | |
| KR | 20-2013-0000376 | | 1/2013 | |
| KR | 101455977 | B1 * | 10/2014 | B65D 17/50 |
| KR | 10-1455977 | | 11/2014 | |
| KR | 10-1648359 | | 8/2016 | |
| KR | 10-1648361 | | 8/2016 | |
| KR | 10-2017-0086426 | | 7/2017 | |
| KR | 10-1807647 | | 12/2017 | |
| WO | 2016-182217 | | 11/2016 | |

OTHER PUBLICATIONS

EPO, Search Report of EP 19830037.8 dated Feb. 2, 2022.
KIPO, PCT Search Report & Written Opinion of PCT/KR2019/007417 dated Sep. 20, 2019.
IPO, Office Action of IN 202047057517 dated Oct. 28, 2021.
APO, Office Action of AU 2019299724 dated Sep. 28, 2021.
IP India, Opposition Notice of IN 202047057517 dated Apr. 8, 2024 and filed reply dated Jun. 6, 2024.

* cited by examiner

【Figure 1A】
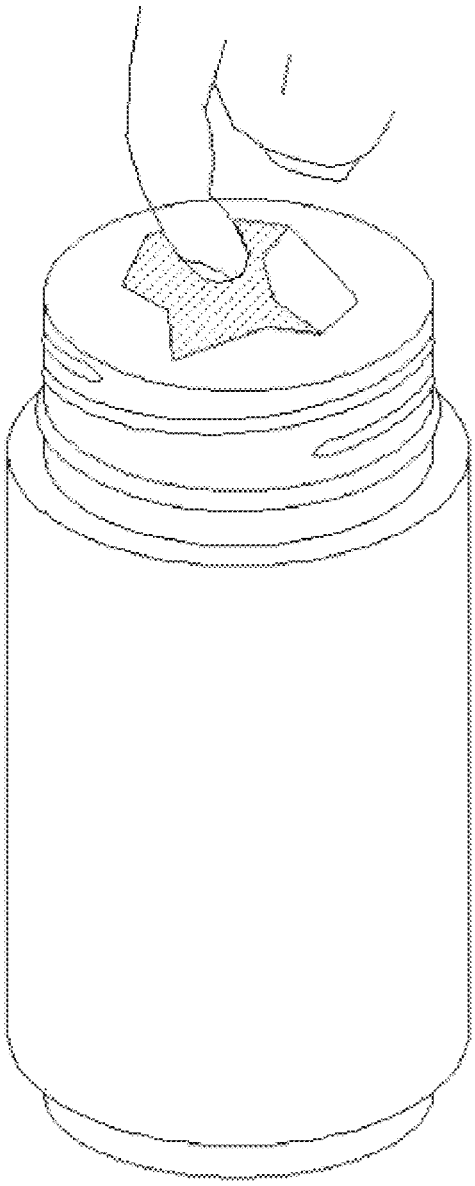

【Figure 1B】
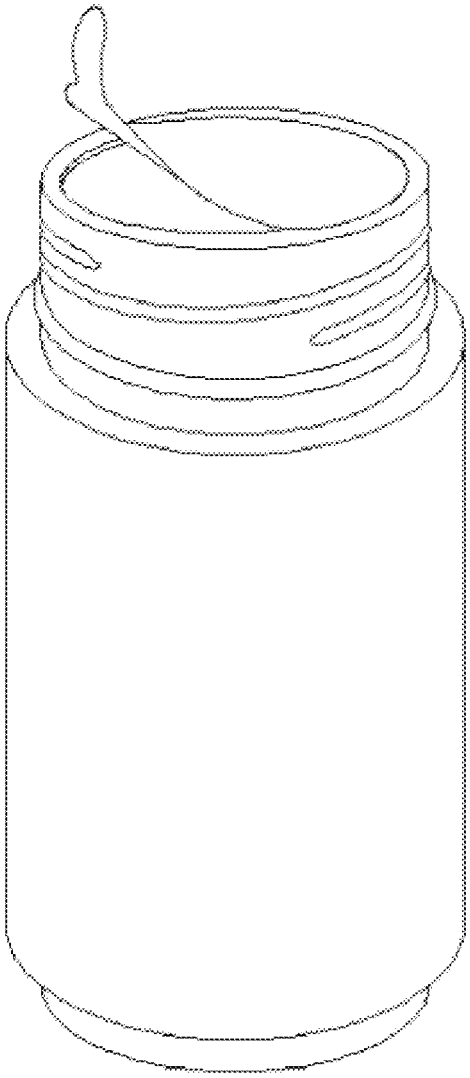

【Figure 1C】
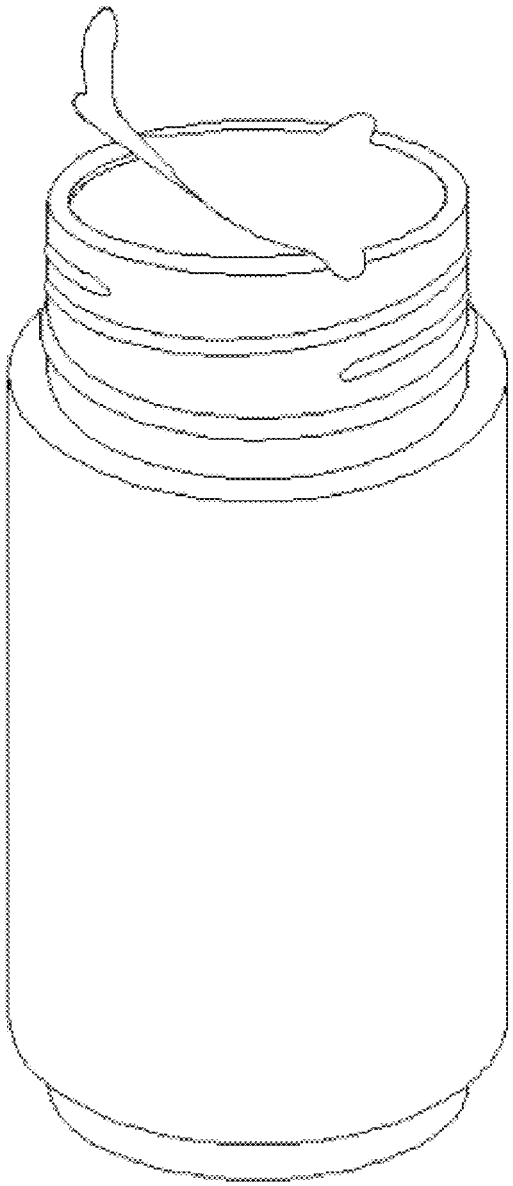

【Figure 1D】
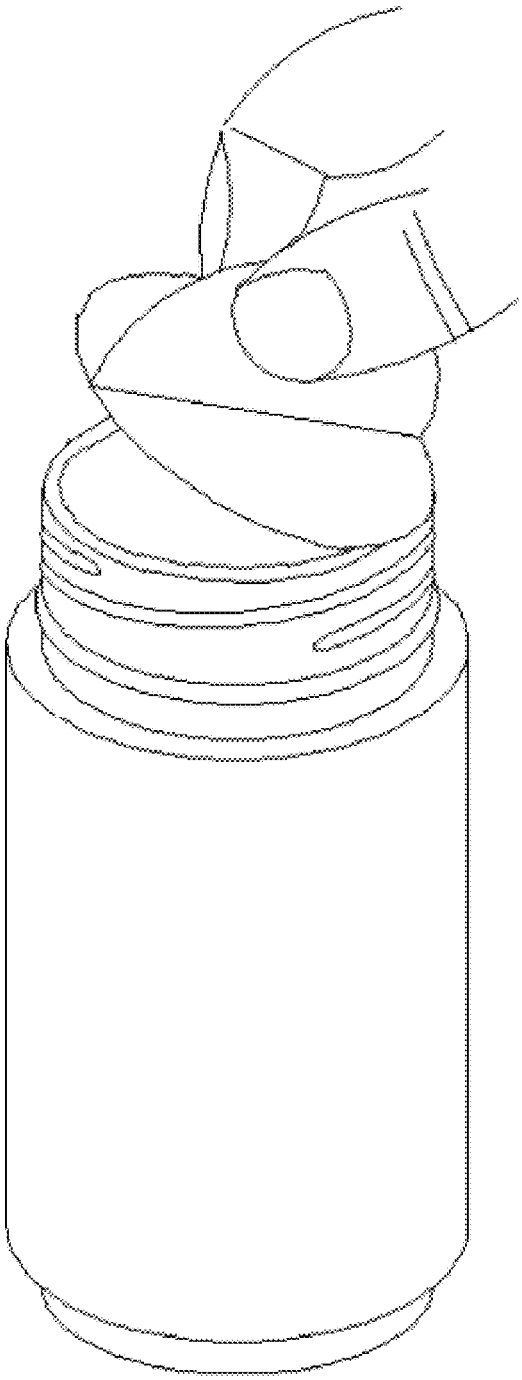

【Figure 2A】
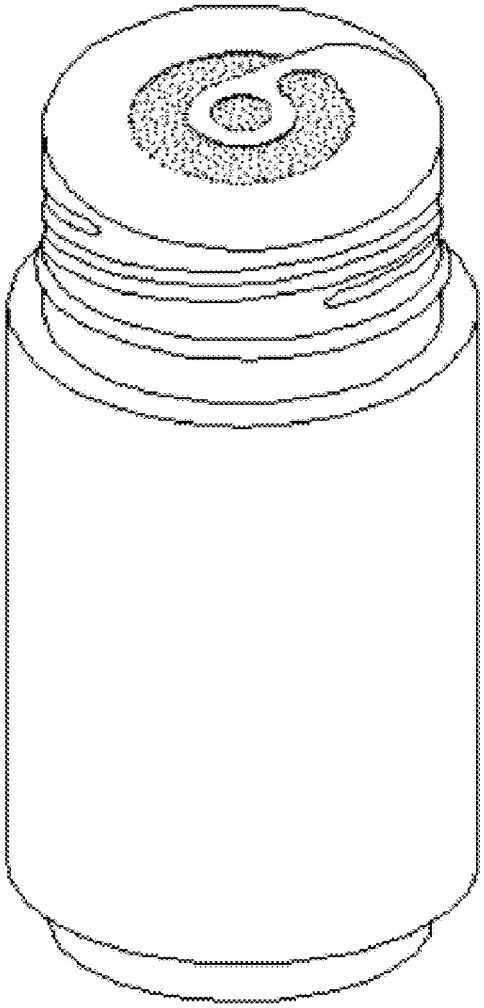

【Figure 2B】
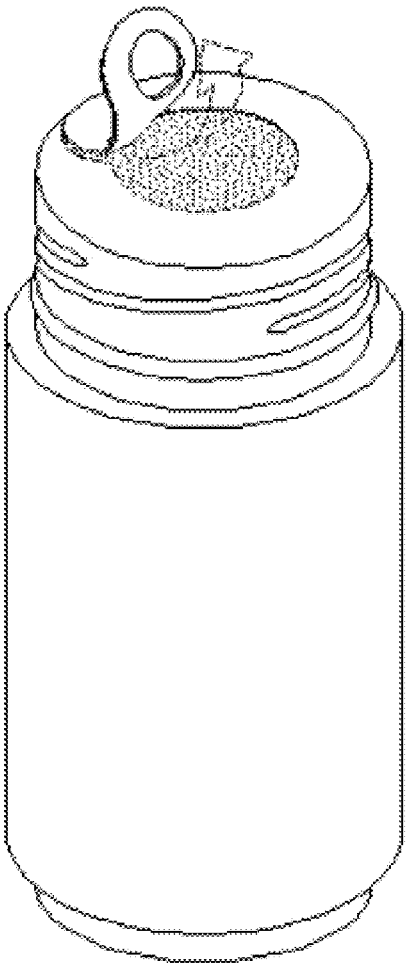

【Figure 2C】
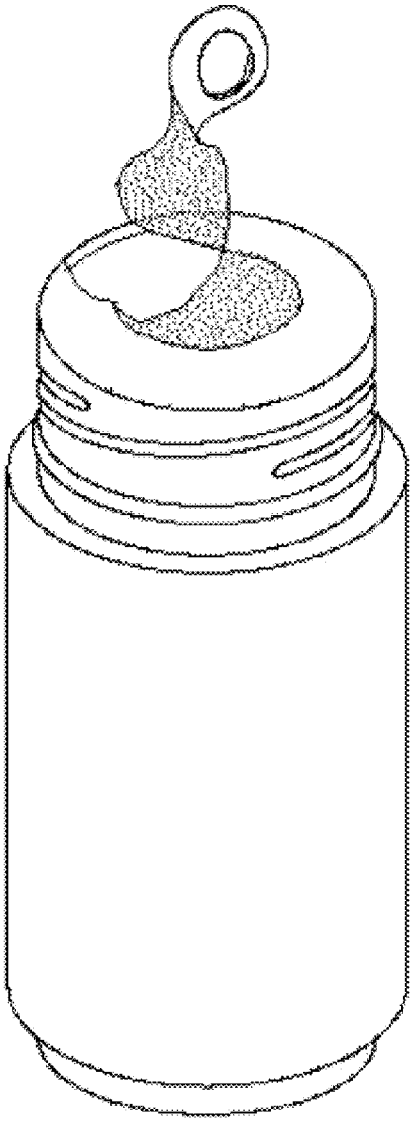

【Figure 2D】
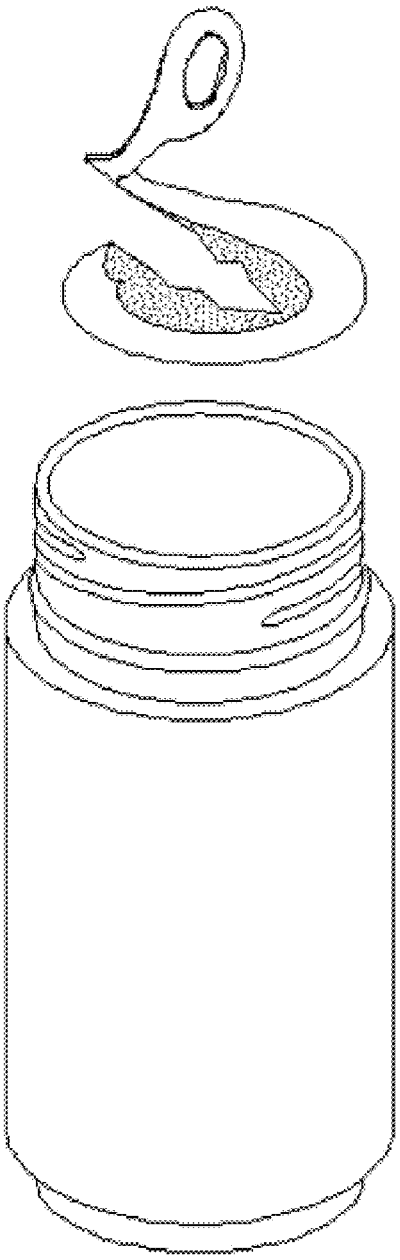

【Figure 3A】
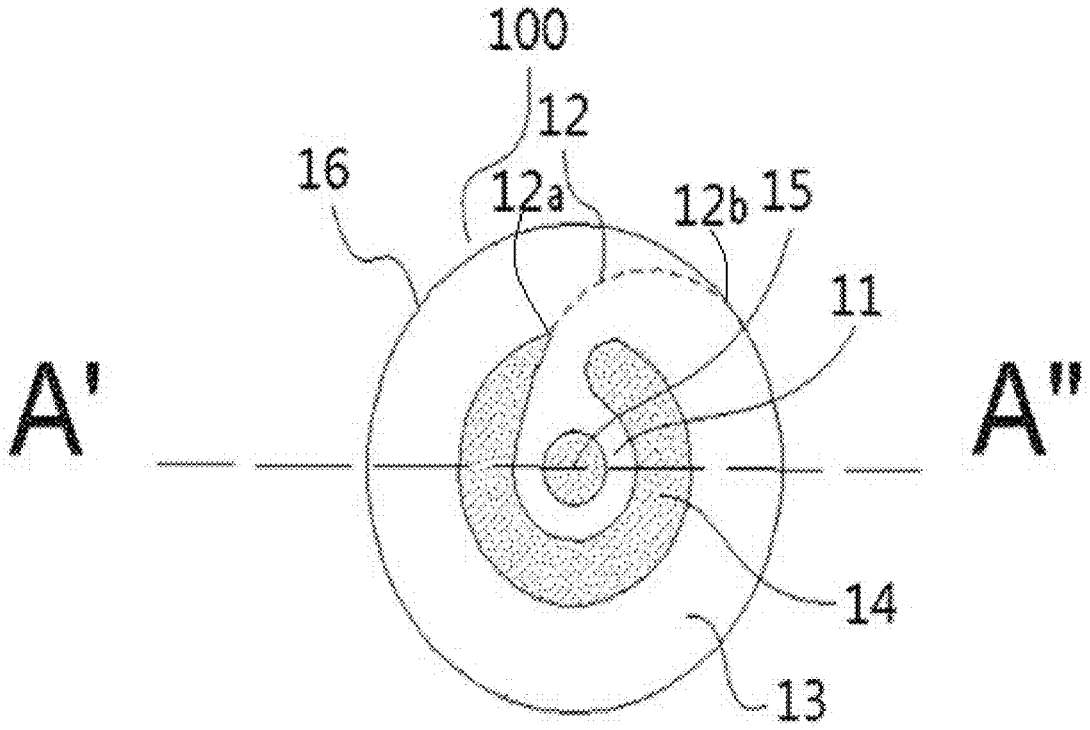
【Figure 3B】
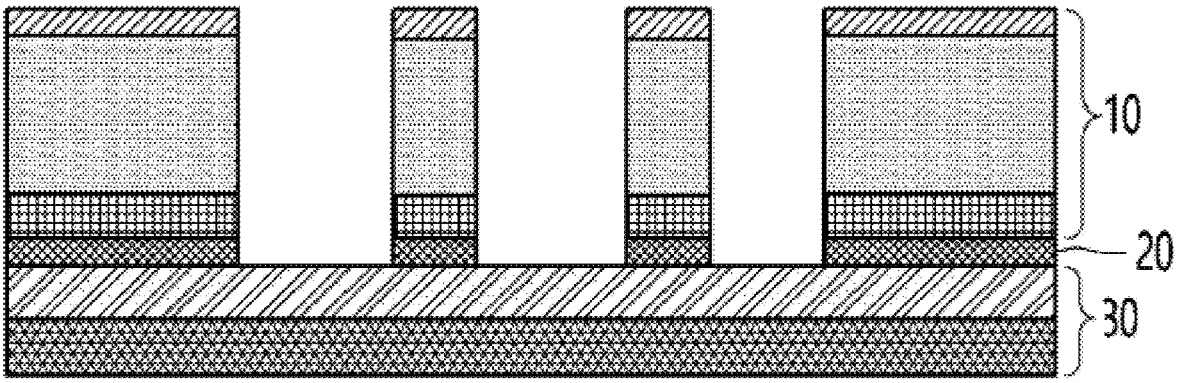

【Figure 3C】
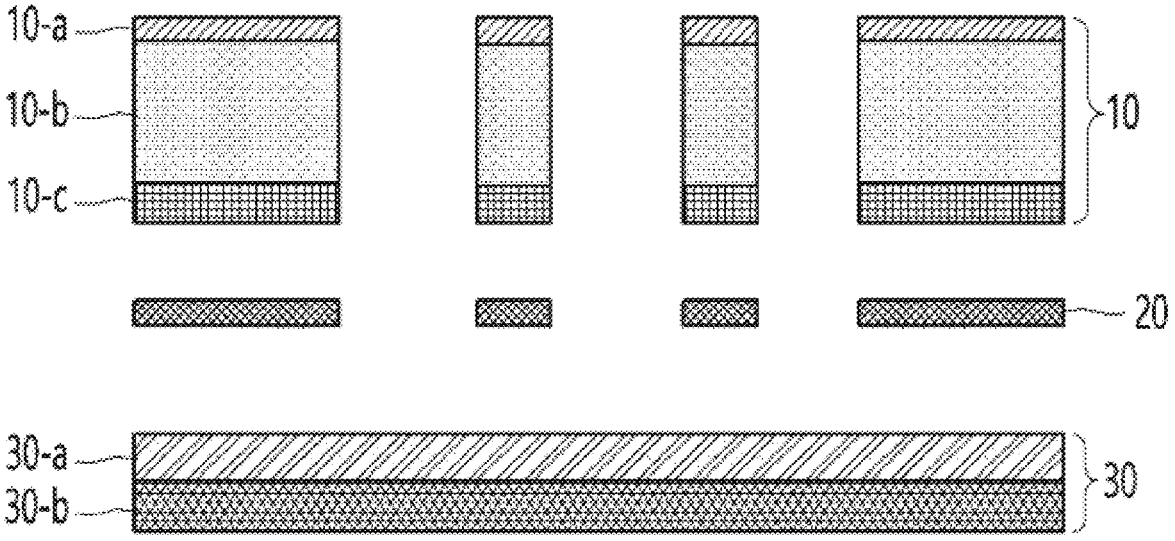
【Figure 4A】
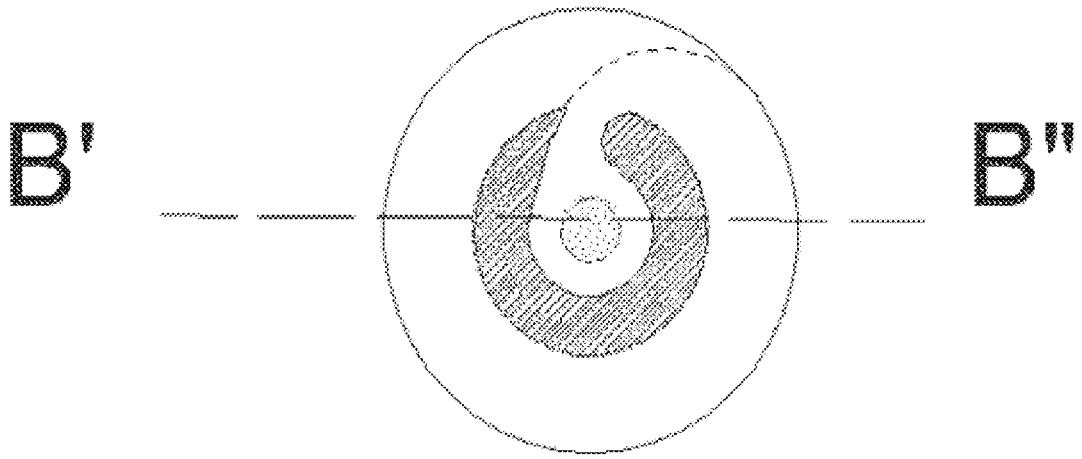

【Figure 4B】
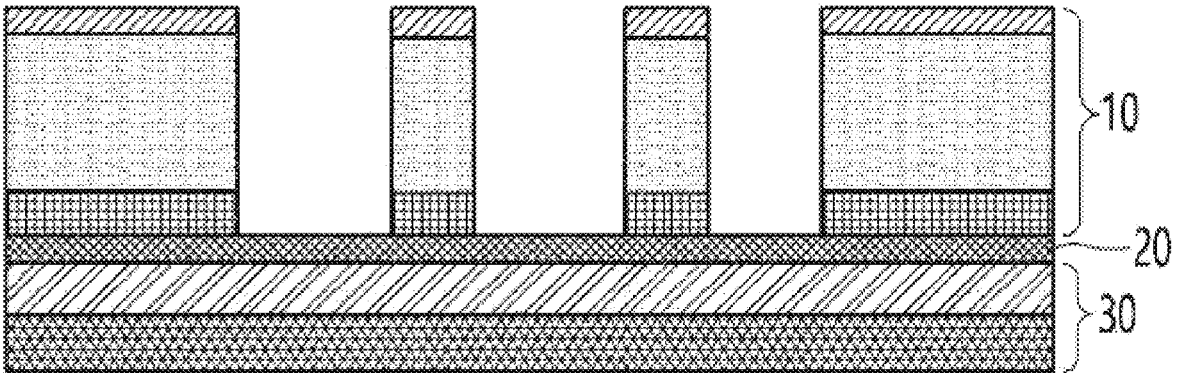
【Figure 4C】
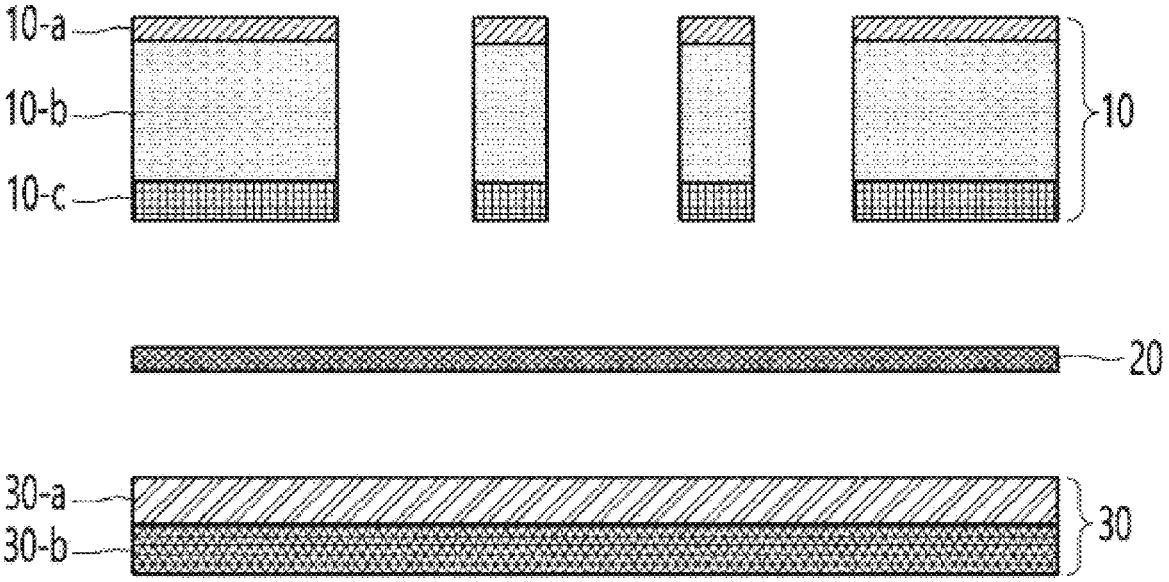

【Figure 5A】
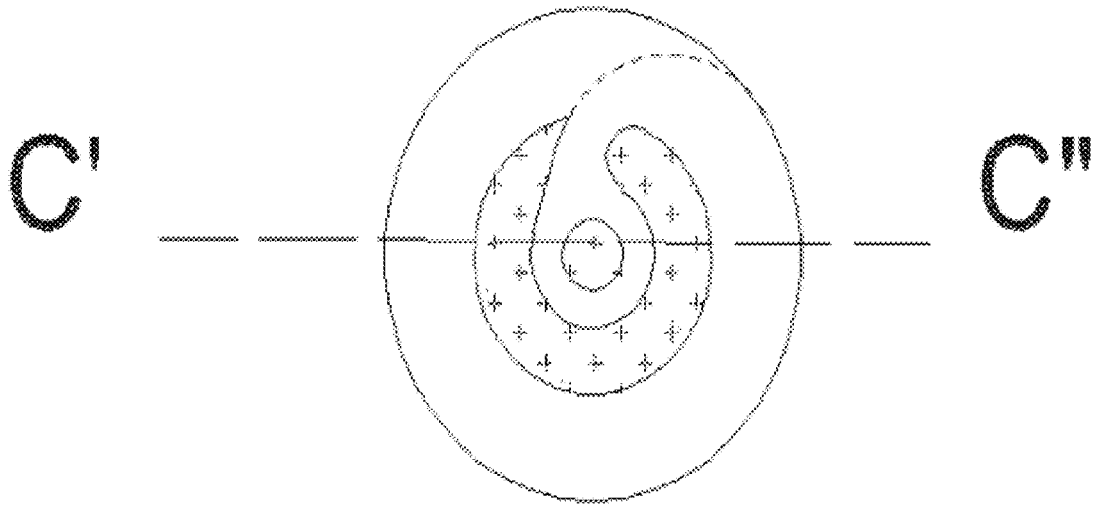
【Figure 5B】
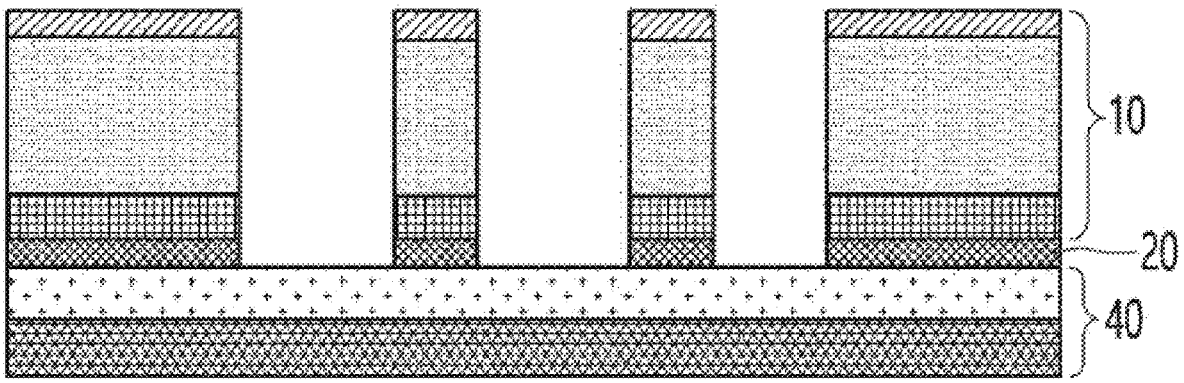

【Figure 5C】
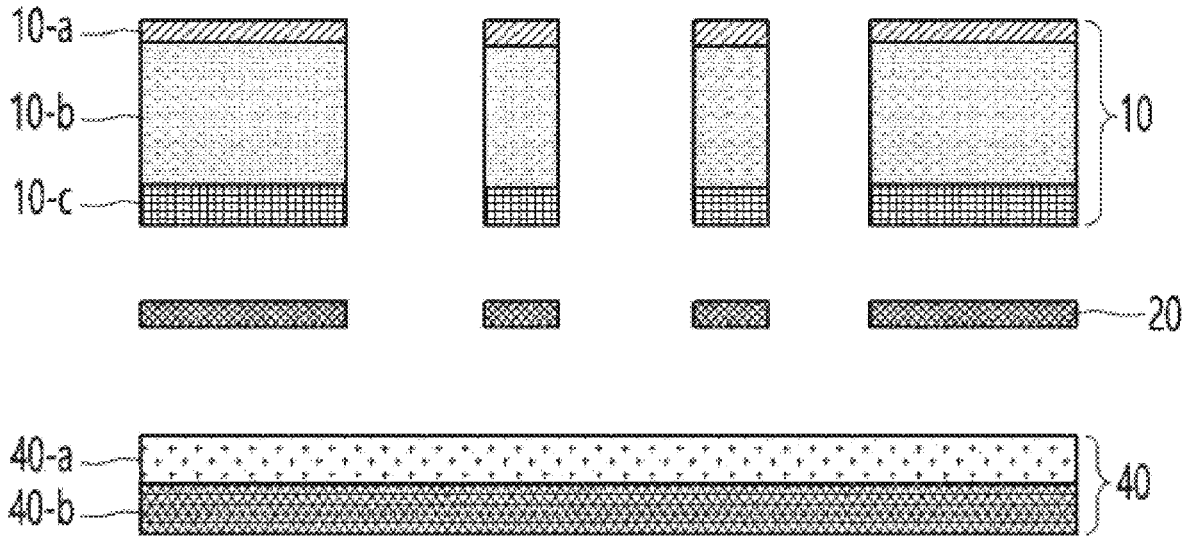
【Figure 6A】
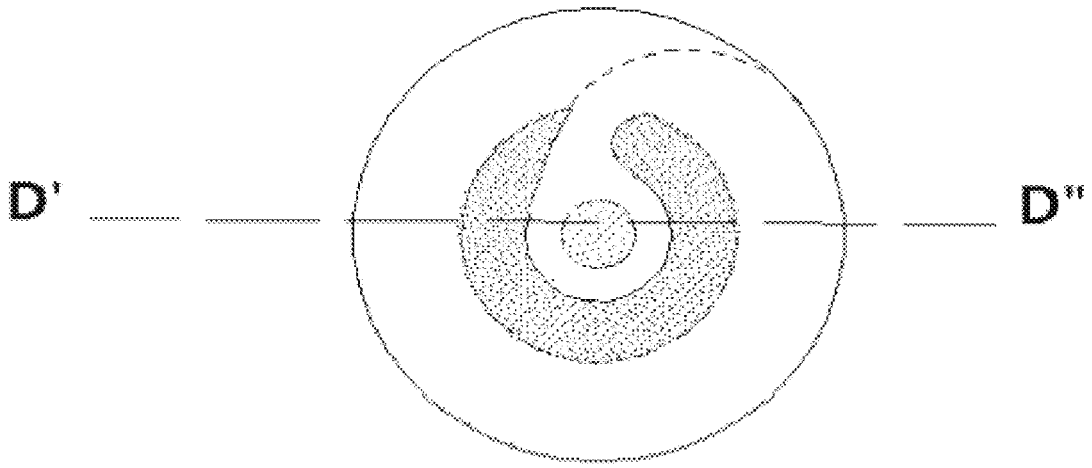

【Figure 6B】
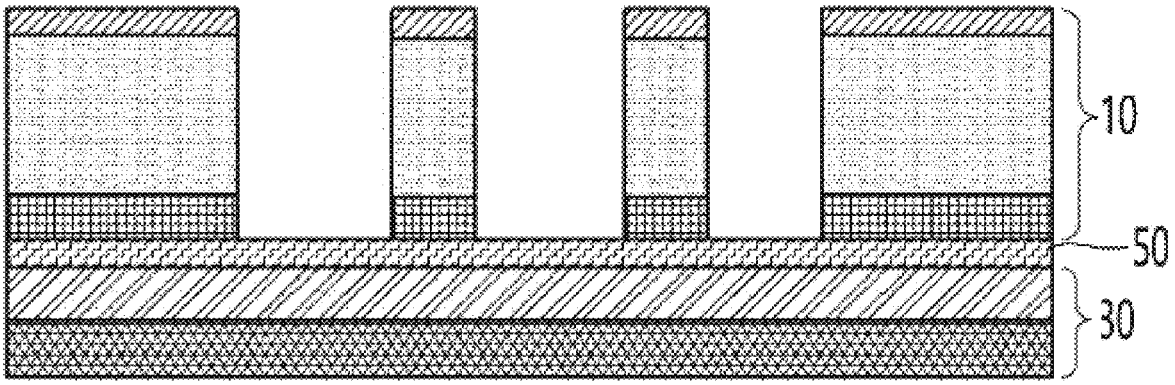
【Figure 6C】
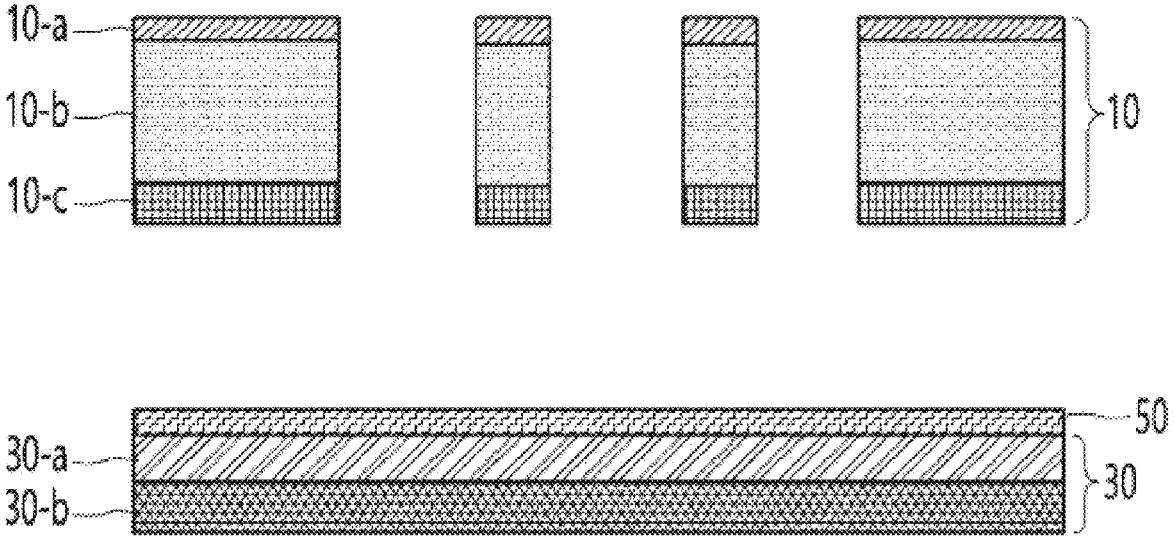

【Figure 7A】
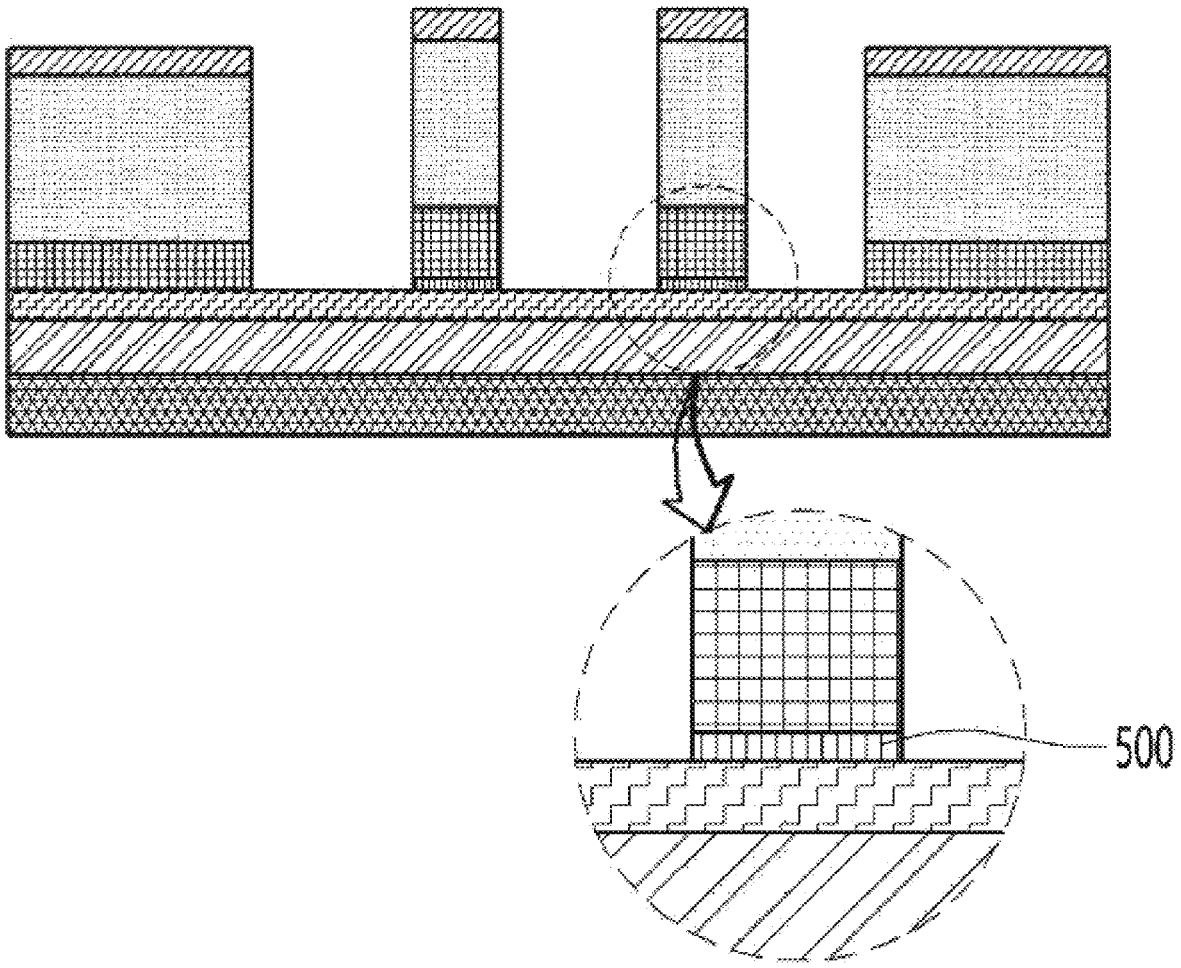

【Figure 7B】
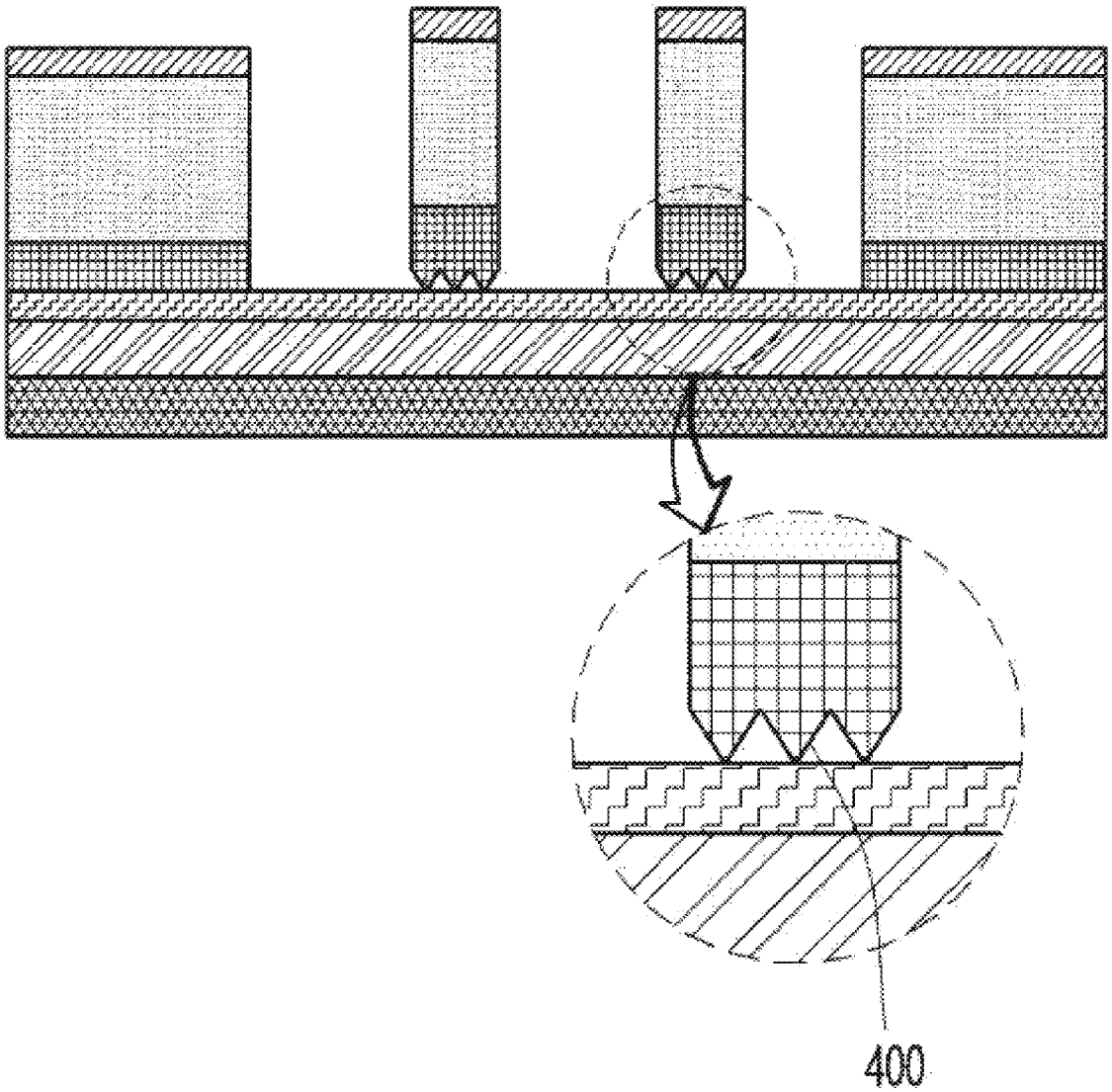

【Figure 7C】
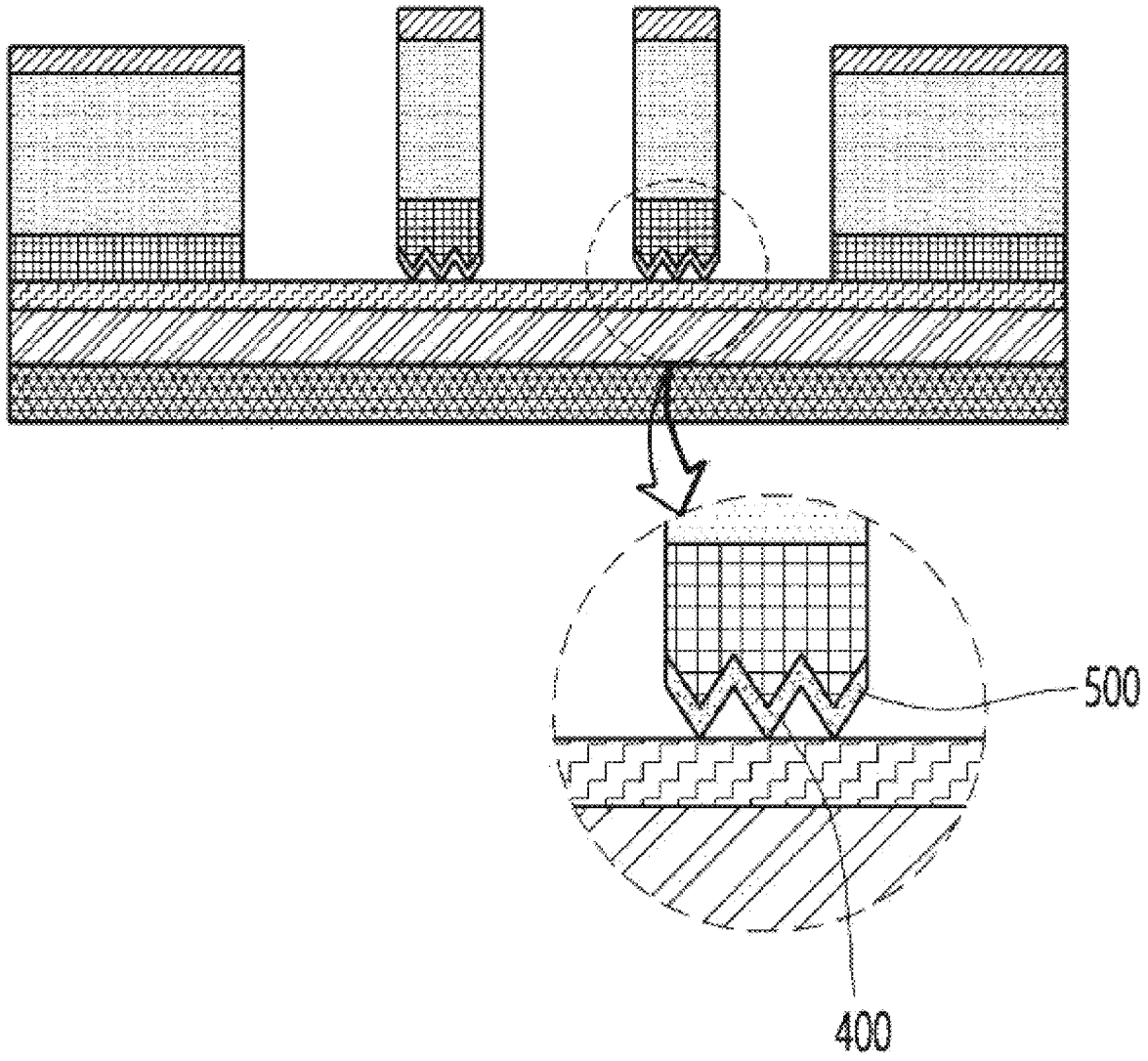

CONTAINER SEALING BODY

TECHNICAL FIELD

The present invention relates to container sealing bodies having various shapes, and the sealing body is removed from a container by a comparatively large opening tab having a circular or straight shape and formed on an upper end of the container in order to open the sealing body from the container. In a first step of opening the sealing body from the container, the container is opened as the opening tab provided at an upper end at a center of the sealing body is pulled upward, and a sealing layer, which includes aluminum foil, which is a lower layer of the sealing body, and a thermal sealing resin layer, is cut and torn to the inlet of the container along an opening initiation guide cutting line connected to the opening tab.

Thereafter, in a second step, as the opening tab continues to be pulled, the container is opened while an outer portion of the sealing body is peeled in an easy peel manner along the inlet of the container, such that the sealing body has a tamper evident function because of a combination of the two opening processes of tearing and peeling the sealing body. Meanwhile, the present invention relates to a technology of a sealing body having a function of allowing the sealing body to be clearly peeled from an inlet of a container.

BACKGROUND ART

A technology for sealing a container made of a material such as plastic or glass in order to protect or preserve contents is commonly known.

In addition, container sealing bodies having various functions and shapes are already widely used.

In addition, sealing bodies having opening tabs having various shapes are used in order to open the containers by conveniently removing the sealing bodies from the containers.

The related art will be described below with reference to FIGS. 1A, 1B, 1C, and 1D.

In the related art, the sealing bodies are used by various types of opening methods classified into a method of opening a container by tearing a sealing body and leaving a torn portion as illustrated in FIG. 1A, and a method of opening a container by peeling a sealing body from an inlet of the container as illustrated in FIGS. 1B, 1C, and 1D. The sealing bodies, which are operated by the above-mentioned examples of the opening methods, each have advantages thereof, but have several types of inconvenience in using the sealing bodies and many problems with stability for protecting consumers.

As illustrated in FIG. 1A, the inlet of the container is sealed with the sealing body by strong welding sealing, such that the sealing body has a tamper evident function of assuredly leaving a torn portion after the container is opened. Therefore, the sealing body has an advantage of protecting a consumer from external malicious behavior and an advantage of providing pressure resistance and impact resistance that allow the sealing body to withstand impact and pressure well. However, there are many problems in that during a process of opening the container by tearing the sealing body with a finger or a tool, the contents are released to the outside or a user's finger is injured by the sealing body made of aluminum foil.

Meanwhile, as illustrated in FIGS. 1B, 1C, and 1D, in the case of the sealing body configured in the form of a peelable seal to be peeled from the container, the user removes the sealing body by holding the opening tab formed on the sealing body and then peeling the sealing body from the inlet of the container. FIGS. 1B and 1C illustrate the method of opening the container by holding the one or two or more opening tabs protruding outward from the sealing body and peeling the sealing body from the inlet of the container. FIG. 1D illustrates the method of opening the container by holding the semi-circular opening tab provided on a central portion at an upper end of the sealing body, lifting the opening tab upward, and peeling the sealing body from the inlet of the container. However, the sealing body in the form of a peelable seal is easily removed and opened from the container. However, because of the nature of the sealing body in the form of a peelable seal, there is a problem in that the sealing body is attached to the container when others seal the container with the sealing body by applying heat again to the sealing body in order to intentionally or maliciously harm the consumers. However, the above-mentioned sealing body has no tamper evident function that protects the consumer from external intrusion.

Further, there is an additional disadvantage in that the opening tab illustrated in FIG. 1B or 1C protrudes outward from the sealing body.

However, in the case of the above-mentioned method, when the sealing body is fastened to the container in a state in which the sealing body is inserted in advance into a cap in order to seal the container with a high-frequency induction heating method, a protruding portion of the sealing body is caught by or trapped between screws provided on the cap and the container, which causes a deterioration in sealing because of a capping defect.

In addition, as illustrated in FIG. 1C, when a user attempts to hold and open a plurality of small opening tabs, the user's hand is injured because the opening tabs are too small. As a result, it is difficult to open the opening tab, which causes discomfort to the user.

Therefore, it is necessary to protect manufacturers and consumers, which use the containers, from external malicious behavior and make it possible to conveniently and easily open the containers.

In the related art, recently, although a problem with recycling of the container, the user partially peels the sealing body in the form of a peelable seal to open the container, and then takes out and uses the contents.

In addition, like a beverage container, when the user peels and tilts only a part of the sealing body without completely removing the sealing body from the container and then discards the container after drinking a beverage, the container cannot be recycled because of the sealing body such as aluminum foil remaining on the inlet of the container.

However, the present invention provides a sealing body which is structured to be peeled from a center of the sealing body to open a container, such that the entire sealing body needs to be completely peeled to use the container, and as a result, even a part of the sealing body does not remain on an inlet of the container, thereby enabling recyclability of the container.

Therefore, the present invention ultimately provides a convenient structure of the opening tab.

In view of the function, the sealing body has a tamper evident function, and provides a clean-peel seal, such that the sealing body needs to be completely separated from the inlet of the container to open the container. Accordingly, the present invention provides a sealing body having convenience and various functions such as contribution to recycling of the container.

DISCLOSURE

Objects to be achieved by the present invention are as follows.

First, in order for a consumer to take out and use contents in a container sealed with a sealing body, the consumer holds an opening tab and peels a sealing body from a container to more conveniently and easily open the sealing body.

Second, since the peeling-type sealing body is torn, cut, and peeled at the same time, the sealing body, which is opened once, cannot be reused, thereby providing the tamper evident function for protection from external malicious behavior.

Third, the sealing body is completely peeled from the inlet of the container in a clean peel manner, thereby solving a problem with the recycling of the container.

The following configuration is provided to achieve the above-mentioned objects.

There is provided a container sealing body applied to seal an inlet of a container, the container sealing body including:

an upper layer;

a lower layer provided below the upper layer; and a thermal bonding resin layer configured between the upper layer and the lower layer and thermally bonded by thermal bonding resin, in which the upper layer includes: a surface layer provided for printing and configured to prevent thermal bonding, a synthetic resin layer having tensile strength and hardness and configured sequentially with the surface layer from above to below, an opening tab is configured by cutting and punching the upper layer, an opening initiation guide cutting line is formed at one side of the opening tab, the lower layer includes a blocking layer for preventing transmission of oxygen or moisture, and a thermal bonding sealing layer, and the synthetic resin layer of the upper layer and the blocking layer of the lower layer are bonded.

In this case, an intermediate base layer having elasticity and having a physically shock absorbing function and a heat blocking function may be further provided between the surface layer and the synthetic resin layer.

In this case, the opening tab may have a circular or structure shape.

In this case, the opening initiation guide cutting line may be partially cut from the opening tab to an outermost circumferential line of the container sealing body.

In this case, the surface layer may be made of a polyester film or a polypropylene film.

In this case, a thickness of the surface layer of the upper layer may be 0.008 to 0.03 mm.

In this case, the intermediate base layer may be configured by a foamed olefin resin film or sheet made by foaming polyolefin-based resin.

In this case, a thickness of the intermediate base layer may be 0.01 to 2 mm.

In this case, the polyolefin-based film may be configured by selecting one of a polyethylene film and a polypropylene film or configured by a film made by synthesizing polyethylene and polypropylene.

In this case, a thickness of the synthetic resin layer may be 0.05 to 0.2 mm.

In this case, the blocking layer may be an aluminum foil layer.

In this case, a thickness of the aluminum foil layer may be 0.007 to 0.1 mm.

In this case, the blocking layer may be a film layer.

In this case, as another configuration, instead of the aluminum foil, the blocking layer may be made of a transparent film layer, such that the sealing body is partially transparent so that a user may check the contents in the container through a transparent portion of the sealing body before opening the container.

In this case, the transparent film layer may be a polyester film, a polyolefin-based film, or a cellophane film.

In this case, the polyolefin-based film may be configured by selecting one of a polyethylene film and a polypropylene film or configured by a film made by synthesizing polyethylene and polypropylene.

In this case, the thermal bonding resin layer may be provided to bond the synthetic resin layer and the blocking layer.

In this case, the thermal bonding resin layer may be made of resin made of a copolymer of ethylene vinyl acetate or ethylene acrylic acid and having strong thermal bondability to metal when the blocking layer is made of metal or is a thin metal layer.

As another method, in the case in which the blocking layer is made of metal or is a thin metal layer, a primer bonding agent made of polyurethane may be applied together with polyolefin-based resin, which is the thermal bonding resin layer, when bonding the upper layer and the lower layer.

In this case, the thermal bonding resin layer is configured such that the upper layer and the lower layer are thermally bonded with force of 2 kg/15 mm.

In this case, the thermal bonding resin layer may be made by integrating a thermal bonding resin film, which has a film shape, with the synthetic resin layer, which is a lower surface of the upper layer, by using a lamination method using a bonding agent, and then the opening tab may be formed by cutting and punching the upper layer and the thermal bonding resin layer.

In this case, the thermal bonding resin layer may be made by integrating thermal bonding resin with the synthetic resin layer by bonding/coating by an extrusion/coating method, and then the opening tab may be formed by cutting and punching the upper layer and the thermal bonding resin layer.

In this case, the thermal bonding resin layer may be provided in advance on an upper surface of the lower layer so as to be thermally bonded to the upper layer.

In this case, the upper layer and the lower layer may be integrated by using the thermal bonding resin layer by a lamination method of extruding, by using an extrusion lamination device, the synthetic resin layer, which is a lower surface of the upper layer, and the blocking layer, which is an upper surface of the lower layer, in a state in which the thermal bonding resin layer is interposed between the synthetic resin layer and the blocking layer, and then applying pressure by using rollers of the extrusion lamination device.

In this case, a lower surface of the opening tab may be embossed to reduce a contact area when the opening tab is laminated with the thermal bonding resin layer, such that the opening tab is easily separated from the lower layer.

In this case, silicone may be provided on the lower surface of the opening tab in order to improve releasability of a lower surface of the opening tab from the thermal bonding resin layer, such that the opening tab is prevented from being thermally bonded to an upper surface of the lower layer by the thermal bonding resin layer during a process of laminating the upper layer and the lower layer.

In addition, the lower surface of the opening tab may be embossed and provided with silicone at the same time.

In this case, a thickness of the thermal bonding resin layer may be 0.015 to 0.05 mm.

In this case, the thermal bonding sealing layer may be made of thermoplastic bonding resin which has an easy peel function and is a seal to be clearly removed from the container.

In this case, in order to seal the container with the thermal bonding sealing layer, a heat seal in the form of a high-frequency induction heat seal or a conduction heat seal may be applied.

First, the sealing body according to the present invention has a tamper evident function. To this end, when the user holds the opening tab and opens the container, the container is opened as the upper layer and the lower layer, which constitute the container sealing body, are cut from a central portion at an upper end of the opening tab to the inlet of the container along the opening initiation guide cutting line.

In addition, the container sealing body is assuredly torn, such that the sealing body cannot be attached to the container again, thereby providing the tamper evident function.

Second, the present invention provides the sealing body having the opening tab structured to be easily opened.

To this end, the opening tab of the sealing body according to the present invention may be configured as a comparatively large opening tab having a circular or straight shape in order to allow a user to easily hold, with his/her finger, the opening tab provided on the upper surface of the sealing body.

When the opening tab is pulled, the opening tab is opened along the opening initiation guide cutting line with minimal effort.

The container sealing body is removed from the container to open the container in an easy clean peel manner from a portion where the inlet of the container is sealed, thereby providing the sealing body for conveniently opening the container.

Third, the sealing body is structured such that the sealing body needs to be structurally and completely removed from the container to open the container and use the contents, such that the sealing body may be clearly removed from the container, thereby enabling recyclability of the container.

DESCRIPTION OF THE DRAWINGS

FIG. 1A is a view illustrating a method of opening a welded seal having no opening tab in the related art.

FIG. 1B is a view illustrating a state in which a user opens a sealing body in the related art by holding one large opening tab attached to an outer portion of the sealing body.

FIG. 1C is a view illustrating a state in which a user opens a sealing body in the related art by holding several small opening tabs attached to an outer portion of the sealing body.

FIG. 1D is a view illustrating a state in which a user opens a sealing body in the related art by holding and lifting up a semi-circular opening tab formed at a center of an upper end portion of the sealing body.

FIG. 2A is a view illustrating a container sealed with a sealing body according to the present invention.

FIG. 2B is a view illustrating a state in which a user holds and lifts up an opening tab to open the sealing body according to the present invention.

FIG. 2C is a view illustrating a state in which a blocking layer and a thermal sealing resin layer of a lower layer are torn and cut together along an opening initiation guide cutting line of an upper layer and the sealing body is opened as the user continues to hold and lift up the opening tab in order to open the sealing body according to the present invention.

FIG. 2D is a view illustrating a state in which the sealing body according to the present invention is completely and clearly removed from the container.

FIG. 3A is a top plan view illustrating a first exemplary embodiment of a container sealing body according to the present invention when viewed from above.

FIG. 3B is a cross-sectional view illustrating the first exemplary embodiment taken along line A'-A" in FIG. 3A.

FIG. 3C is an exploded cross-sectional view illustrating the first exemplary embodiment in which a cross section illustrated in FIG. 3A is divided into an upper layer, a thermal bonding resin layer, a lower layer, and the like.

FIG. 4A is a top plan view illustrating a second exemplary embodiment of the present invention when viewed from above.

FIG. 4B is a cross-sectional view illustrating the second exemplary embodiment taken along line B'-B" in FIG. 4A.

FIG. 4C is an exploded cross-sectional view illustrating the second exemplary embodiment in which a cross section illustrated in FIG. 4A is divided into an upper layer, a thermal bonding resin layer, a lower layer, and the like.

FIG. 5A is a top plan view illustrating a third exemplary embodiment of the present invention when viewed from above.

FIG. 5B is a cross-sectional view illustrating the third exemplary embodiment taken along line C'-C" in FIG. 5A.

FIG. 5C is an exploded cross-sectional view illustrating the third exemplary embodiment in which a cross section illustrated in FIG. 5A is divided into an upper layer, a thermal bonding resin layer, a lower layer, and the like.

FIG. 6A is a top plan view illustrating a fourth exemplary embodiment of the present invention when viewed from above.

FIG. 6B is a cross-sectional view illustrating the fourth exemplary embodiment taken along line D'-D" in FIG. 5A.

FIG. 6C is an exploded cross-sectional view illustrating the fourth exemplary embodiment in which a cross section illustrated in FIG. 5A is divided into an upper layer, a thermal bonding resin layer, a lower layer, and the like.

FIG. 7A is a view illustrating a state in which a silicone portion 500 is formed only on a lower surface of an opening tab of an upper layer of a sealing body.

FIG. 7B is a view illustrating a state in which an uneven portion 400 is formed only on the lower surface of the opening tab of the upper layer of the sealing body.

FIG. 7C is a view illustrating a state in which the uneven portion 400 and the silicone portion 500 are formed only on the lower surface of the opening tab of the upper layer of the sealing body.

MODE FOR INVENTION

FIGS. 3A to 3C, which correspond to a first exemplary embodiment, will be described below.

FIG. 3A is a top plan view, and FIG. 3B is a cross-sectional view taken along line A'-A".

FIG. 3C is a view illustrating a state in which FIG. 3B is divided into an upper layer, a thermal bonding resin layer, and a lower layer.

A container sealing body 100 applied to seal an inlet of a container includes:

a lower layer 30 configured below the upper layer 10; and a thermal bonding resin layer 20 configured between the upper layer 10 and the lower layer 30 and thermally bonded by thermal bonding resin, in which the upper layer includes: a surface layer 10-*a* provided for printing and configured to prevent thermal bonding; and a synthetic resin layer 10-*c* having tensile strength and hardness and configured sequentially with the surface layer from above to below, and the upper layer is cut and punched to form an opening tab 11.

An opening initiation guide cutting line 12 extends to a sealing body cutting line 16 to partially cut the opening tab.

Cut-out portions 14 and 15 of the upper layer are cut out by punching to form the opening tab from the upper layer.

In this case, the upper layer may be punched and cut to form the opening tab 11 after attaching the thermal bonding resin layer 20 integrally to the upper layer 10 or applying the thermal bonding resin onto the upper layer 10, or a separate film layer may be interposed or attached between the upper layer 10 and the lower layer 30 after the upper layer 10 and the lower layer 30 are manufactured.

In addition, the thermal bonding resin layer may be attached in advance to the lower layer 30 and then attached to the upper layer 10.

The opening initiation guide cutting line 12 is formed at one side of the opening tab, and the lower layer includes a blocking layer 30-*a* for preventing transmission of oxygen or moisture, and a thermal bonding sealing layer 30-*b*, such that the container sealing body includes the thermal bonding resin layer 20 that bonds the synthetic resin layer 10-*c* of the upper layer and the blocking layer of the lower layer.

In this case, an intermediate base layer 10-*b* having elasticity and having a physically shock absorbing function and a heat blocking function is further provided between the surface layer 10-*a* and the synthetic resin layer 10-*c*.

In this case, the opening tab 11 has a circular or straight shape.

FIGS. 3A to 3C illustrate the opening tab having a circular shape.

In this case, the opening initiation guide cutting line 12 is cut in the form of a dotted line having a stitched shape from a contact point 12*a* of the opening tab 11 to an edge point 12*b* of an outer peripheral portion 13 of the sealing body along an outermost circumferential line of the container sealing body, such that the opening initiation guide cutting line 12 allows a user to easily tear the opening tab by holding and pulling the opening tab.

In this case, the surface layer 10-*a* may be made of a polyester film or a polypropylene film.

In this case, the surface layer 10-*a* of the upper layer 10 may have a thickness of 0.008 to 0.03 mm.

In this case, the intermediate base layer 10-*b* may be configured as a foamed olefin resin film or sheet made by foaming polyolefin-based resin.

In this case, a thickness of the intermediate base layer 10-*b* may be 0.01 to 2 mm.

In this case, the synthetic resin layer 10-*c* may be configured by selecting one of a polyester film, a polypropylene film, and a polycarbonate film which are biaxially stretched.

In this case, a thickness of the synthetic resin layer 10-*c* may be 0.05 to 0.2 mm.

In this case, the blocking layer 30-*a* may be an aluminum foil layer.

In this case, a thickness of the aluminum foil layer may be 0.007 to 0.1 mm.

In the case in which the blocking layer 30-*a* is made of metal or is a thin metal layer, the thermal bonding resin layer 20 may be made of resin having a copolymer of ethylene vinyl acetate or ethylene acrylic acid having strong thermal bondability to metal.

In the case in which the blocking layer 30-*a* is made of metal or is a thin metal layer, a primer bonding agent made of polyurethane may be applied together with polyolefin-based resin, which is the thermal bonding resin layer 20, when bonding the upper layer 10 and the lower layer 30.

The thermal bonding resin layer 20 may be configured such that the upper layer and the lower layer are thermally bonded with force of 2 kg/15 mm.

A thickness of the thermal bonding resin layer 20 may be 0.015 to 0.05 mm.

The thermal bonding sealing layer 30-*b* may be made of thermoplastic bonding resin which is a seal to be clearly removed from the container.

In order to seal the container with the thermal bonding sealing layer 30-*b*, a heat seal in the form of a high-frequency induction heat seal or a conduction heat seal may be applied.

Referring to the cross-sectional view of FIG. 3B, the intermediate thermal bonding resin layer 20 may be formed by laminating the thermal bonding resin film having a film shape onto the synthetic resin layer 10-*c*, which is a lower surface of the upper layer, by a method using a bonding agent, or by bonding the thermal bonding resin directly to the synthetic resin layer 10-*c* by a method using extrusion coating.

The opening tab 11 and the opening initiation guide cutting line 12 are formed by cutting and punching the upper layer 10 and the thermal bonding resin layer 20, which are integrated as described above, and then the upper layer 10 and the thermal bonding resin layer 20 are thermally bonded, by applying heat and pressure, to the film layer which is the aluminum foil layer or the blocking layer which is an upper surface of the lower layer 30.

DETAILED DESCRIPTION OF THE EMBODIMENTS

The following description will be made with reference to the drawings.

The description will be made with reference to FIGS. 2A to 2D.

FIGS. 2A to 2D illustrate a process of separating, from the container, the container sealing body applied to seal the inlet of the container.

The drawings illustrate that the opening tab is easily and completely removed from the inlet of the container. The drawings illustrate that the container sealing body may be easily removed from the inlet of the container while ensuring recyclability and tamper evidence of the container.

A first exemplary embodiment has been already described as the best exemplary embodiment with reference to FIGS. 3A to 3C.

A second exemplary embodiment will be described below with reference to FIGS. 4A to 4C.

FIG. 4A is a top plan view, and

FIG. 4B is a cross-sectional view taken along line B'-B".

FIG. 4C is a view illustrating a state in which FIG. 4B is divided into an upper layer, a thermal bonding resin layer, and a lower layer.

The upper layer and the lower layer are integrated by using the thermal bonding resin layer 20, by a lamination method of extruding, by using an extrusion lamination device, the synthetic resin layer 10-*c*, which is the lower surface of the upper layer 10, and the blocking layer 30-*a*, which is the upper surface of the lower layer 30, in the state in which the thermal bonding resin layer 20 is interposed between the synthetic resin layer 10-*c* and the blocking layer 30-*a*, and then applying pressure by using rollers of the extrusion lamination device.

In this state, the thermal bonding resin layer 20 is not configured integrally with the upper layer or the lower layer.

FIGS. 3A to 3C according to the first exemplary embodiment illustrate that the thermal bonding resin layer 20 is integrally attached to or applied onto the upper layer and the upper layer is punched to manufacture the opening tab. The second exemplary embodiment corresponds to still another exemplary embodiment of the first exemplary embodiment.

In this case, the thermal bonding resin layer 20 may be provided to bond the synthetic resin layer 10-*c* and the blocking layer 30-*a*.

As illustrated in FIG. 4B, the container sealing body 100 is configured by integrating the synthetic resin layer 10-*c*, which is the lower surface of the upper layer 10, and the aluminum foil layer or the blocking film layer, which is the upper surface of the lower layer 30, by a lamination method using the thermal bonding resin layer by extruding, by using the extrusion lamination machine, the upper layer 10, in which the opening tab 11 and the opening initiation guide cutting line 12 are already formed, and the lower layer 30 in the state in which the thermal bonding resin layer 20 is interposed between the upper layer and the lower layer, and then applying pressure by using the rollers or the like.

A third exemplary embodiment will be described below with reference to FIGS. 5A to 5C.

FIG. 5A is a top plan view, and

FIG. 5B is a cross-sectional view taken along line C'-C".

FIG. 5C is a view illustrating a state in which FIG. 5B is divided into an upper layer, a thermal bonding resin layer, and a lower layer.

The blocking layer 40-*a* is a film layer, the film layer is made of a polyester film, a polyolefin-based film, or a cellophane film, and the polyolefin-based film is configured by selecting one of a polyethylene film and a polypropylene film or configured by a film made by synthesizing polyethylene and polypropylene.

A thermal bonding sealing layer 40-*b* is provided below a blocking layer.

The blocking layer 40-*a* may be made by using a transparent film, such that the lower layer 40 is transparent and the sealing body is partially transparent, thereby enabling the user to check contents in the container.

The thermal bonding resin layer 20 is made by integrating a thermal bonding resin film, which has a film shape, with the synthetic resin layer 10-*c*, which is the lower surface of the upper layer, by using the lamination method using a bonding agent, and then the opening tab is formed by cutting and punching the upper layer 10 and the thermal bonding resin layer 20.

According to another method, the thermal bonding resin layer 20 may be made by integrating thermal bonding resin with the synthetic resin layer 10-*c* by bonding/coating by an extrusion/coating method, and then the opening tab may be formed by cutting and punching the upper layer and the thermal bonding resin layer.

In the case of the third exemplary embodiment, the method using the conduction heat seal, which does not require high-frequency induction heating, is used, and the transparent film is used, instead of the aluminum foil, as the sealing body for sealing the container, such that the sealing body is partially transparent, thereby enabling the user to check the contents in the container. In addition, because there is no metal component, the sealing body may be used to perform an X-ray inspection for detecting foreign substances such as metal fragments in the container.

According to the first exemplary embodiment, the thermal bonding resin layer 20 is configured such that resin (polymer), which is made of a copolymer of ethylene vinyl acetate or ethylene acrylic acid and has strong thermal bondability to metal, is formed on the lower surface of the synthetic resin layer 10-*c* which is the lower surface of the upper layer 10, and the thermal bondability resin is thermally bonded directly to the lower aluminum foil layer.

The second exemplary embodiment uses the above-mentioned thermal bonding resin layer 20, like the first exemplary embodiment. However, the second exemplary embodiment sometimes uses a primer bonding agent made of polyurethane in order to increase bonding force on the surface of the aluminum foil layer and laminates a polyolefin-based bonding resin made of polyethylene in order to bond the upper layer and the lower layer in a roll shape by extrusion/lamination.

A thickness of the bonding resin is 0.015 to 0.05 mm depending on the use of the bonding resin and bonding strength.

In the case of the third exemplary embodiment, the transparent film layer is provided on the upper surface of the lower layer instead of the aluminum foil, such that when viewing the sealing body from above, the user may check the contents in the container, which is not opened, through the portion at the periphery of the opening tab, which is removed from the upper layer by cutting and punching, and the transparent film layer of the lower layer.

In the case of a fourth exemplary embodiment, the thermal bonding resin layer 20 is provided on the lower surface of the upper layer, like the first exemplary embodiment, or the thermal bonding resin layer is provided on the upper surface of the lower layer so that the lower layer is thermally bonded to the upper layer without simultaneously laminating the thermal bonding resin layer 20, the upper layer, and the lower layer by using the extrusion lamination method, unlike the second exemplary embodiment.

A thickness of the surface layer of the upper layer of the sealing body is 0.008 to 0.03 mm. The surface layer may be made of a polyester film or a polypropylene film.

The intermediate base layer of the upper layer is configured as a foamed resin film or sheet made by foaming polyolefin-based resin having a heat blocking function, elasticity, and a physically shock absorbing function, and the intermediate base layer may be omitted depending on the use thereof. A thickness of the foamed resin layer is 0.01 to 2 mm depending on the use of the foamed resin layer.

The synthetic resin layer provided on the lower portion of the upper layer is configured by a film made of polyester, polypropylene, or polycarbonate which is biaxially stretched, and the synthetic resin layer has high hardness and tensile force and has a thickness of 0.05 to 0.2 mm.

In particular, the polyester film is excellent in view of costs and performance.

A thickness of the blocking layer of the lower layer is 0.007 to 0.1 mm depending on the use of the blocking layer. The thermal bonding sealing layer provided below the blocking layer is made of the thermoplastic bonding resin which is a clean-peelable seal which is clearly peeled from the container.

A fourth exemplary embodiment will be described below with reference to FIGS. 6A to 6C.

FIG. 6A is a top plan view, and

FIG. 6B is a cross-sectional view taken along line D'-D".

FIG. 6C is a view illustrating a state in which FIG. 6B is divided into the upper layer 10, the thermal bonding resin layer 50, and the lower layer 30.

In this case, the thermal bonding resin layer 50 is provided in advance on the upper surface of the lower layer 30 so as to be thermally bonded to the upper layer 10.

A fifth exemplary embodiment will be described below with reference to FIGS. 7A and 7B.

FIG. 7A will be described below.

In order to improve releasability of the lower surface of the opening tab 11 from the thermal bonding resin layer 20, the lower surface of the opening tab 11 is embossed to have a silicone portion 500, thereby preventing the opening tab 11 from being thermally bonded to the upper surface of the lower layer 30 by the thermal bonding resin layer 20 during the process of laminating the upper layer 10 and the lower layer 30.

FIG. 7B will be described below.

An uneven portion 400 (which is described as an uneven portion formed to have a serrated waveform but may have any shape) is provided on the lower surface of the opening tab to reduce a contact area when the opening tab is laminated with the thermal bonding resin layer 20, thereby allowing the opening tab to be easily separated from the lower layer.

FIG. 7C will be described below.

The lower surface of the opening tab is embossed to have the uneven portion 400 to reduce the contact area when the opening tab is laminated with the thermal bonding resin layer 20, thereby allowing the opening tab 11 to be easily separated from the lower layer 30. In addition, in order to improve releasability from the thermal bonding resin layer 20, the silicone is provided on the lower surface of the opening tab which is embossed in a concave-convex shape, thereby preventing the opening tab 11 from being thermally bonded to the upper surface of the lower layer 30 by the thermal bonding resin layer 20 during the process of laminating the upper layer 10 and the lower layer 30. As a result, the opening tab 11 may be easily separated from the thermal bonding resin layer 20.

That is, in the above-mentioned exemplary embodiments, the upper layer 10 and the lower layer 30 are integrated as a result of performing the method of extruding, laminating, and bonding the upper layer 10 and the lower layer 30, but even the lower surface of the opening tab 11 formed on the upper layer 10 is thermally bonded, by the thermal bonding resin layer 20, to the aluminum foil layer or the film layer which is the upper surface of the lower layer 30.

For this reason, because the lower surface of the opening tab is attached to the aluminum foil layer or the film layer, it is difficult to separate the opening tab and open the container. As a method of solving this problem, as illustrated in FIGS. 7A, 7B, and 7C, only the lower surface of the opening tab 11 is embossed with a lattice pattern or the like to form the uneven portion 400 on the surface and thus reduce a contact area when the opening tab is laminated with the thermal bonding resin layer 20, thereby preventing the opening tab from being easily attached to the thermal bonding resin layer.

In order to further improve releasability from the thermal bonding resin layer 20, the silicone portion 500 is provided only on the lower surface of the opening tab, thereby preventing the opening tab from being thermally bonded to the upper surface of the lower layer 30 by the thermal bonding resin layer 20 during the process of laminating the upper layer 10 and the lower layer 30.

With the above-mentioned configuration, the opening tab 11 may not be attached to the lower layer 30 and may be easily separated from the upper surface of the sealing body with a finger, and then the user may hold the opening tab 11 and conveniently open the container.

Terms or words used in the present specification and the claims should not be interpreted as being limited to a general or dictionary meaning. Terms or words used in the present specification and the claims should be interpreted as a meaning and a concept which conform to the technical spirit of the present disclosure based on a principle that an inventor can appropriately define a concept of a term in order to describe his/her own invention by the best method.

Therefore, the exemplary embodiments disclosed in the present specification and the configurations illustrated in the drawings are just the best preferred exemplary embodiments of the present invention. The exemplary embodiments do not represent all the technical spirit of the present invention. Accordingly, it should be appreciated that various equivalents and modified examples capable of substituting the exemplary embodiments may be made at the time of filing the present application.

INDUSTRIAL APPLICABILITY

The present invention is industrially applicable.

First, in order for a consumer to take out and use the contents in the container sealed with the sealing body, the consumer holds the opening tab and peels the sealing body from the container to more conveniently and easily open the sealing body.

Second, since the peeling-type sealing body is torn, cut, and peeled at the same time, the sealing body, which is opened once, cannot be reused, thereby providing the tamper evident function for protection from external malicious behavior.

Third, the sealing body is completely peeled from the inlet of the container in a clean peel manner, thereby solving a problem with the recycling of the container. Accordingly, the present invention is industrially applicable.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

The invention claimed is:

1. A container sealing body applied to seal an inlet of a container, the container sealing body comprising:

an upper layer;

a lower layer provided below the upper layer; and a thermal bonding resin layer configured between the upper layer and the lower layer and thermally bonded by thermal bonding resin, wherein an opening tab is at least a part of the upper layer, the opening tab being separable from the lower layer, wherein an opening initiation guide cutting line is formed at one side of the opening tab, wherein the opening initiation guide cutting line is configured to cut partially from the opening tab to an outermost circumferential edge line of the container sealing body, wherein the lower layer comprises a blocking layer for preventing transmission of oxygen or moisture, and a thermal bonding sealing layer, wherein the thermal bonding resin layer is disposed below the blocking layer, and is separable from the container, wherein the upper layer and the lower layer are bonded by the thermal bonding resin layer, wherein the container sealing body overlaying a rim of the container defining the inlet, wherein when the opening tab is lifted away from the lower layer and pulled, the opening initiation guide cutting line is torn to the outermost circumferential edge line and the container sealing body is lifted from the rim with continued pulling of the opening tab to thereby peel the container sealing body completely from the rim to open the inlet of the container in use, and simultaneously peel a circumferential portion of the container sealing body overlaying a rim having a width completely from the rim, wherein the opening tab connects to an outer peripheral portion of the container sealing body at a contact point, and the opening initiation guide cutting line is bonded to the lower layer and extends from the contact point to an edge point of the outermost circumferential edge line, and wherein the opening initiation guide cutting line is formed by a dotted line penetrating only the upper layer, and wherein the lower layer is intact and not cut below the opening initiation guide cutting line prior to opening.

2. The container sealing body of claim 1, wherein the blocking layer comprises a film layer, or a metal or a thin metal layer.

3. The container sealing body of claim 2, wherein the film layer is a polyester film, a polyolefin-based film, or a cellophane film, and the metal or the thin metal layer comprises aluminum foil layer.

4. The container sealing body of claim 3, wherein the polyolefin-based film is configured by selecting one of a polyethylene film or a polypropylene film or configured by a film made by synthesizing polyethylene and polypropylene.

5. The container sealing body of claim 2, wherein the film layer is made by using a transparent film, such that the sealing body is partially transparent so that contents in the container are checked.

6. The container sealing body of claim 2, wherein the thermal bonding resin layer is made by integrating a thermal bonding resin film, which has a film shape, with the upper layer, which is a lower surface of the upper layer, by using a lamination method using a bonding agent, and then the opening tab is formed by cutting and punching the upper layer and the thermal bonding resin layer.

7. The container sealing body of claim 2, wherein the thermal bonding resin layer is made by integrating thermal bonding resin with the upper layer by bonding coating by an extrusion coating method, and then the opening tab is formed by cutting and punching the upper layer and the thermal bonding resin layer.

8. The container sealing body of claim 1, wherein the upper layer and the lower layer are integrated by using the thermal bonding resin layer by a lamination method of extruding, by using an extrusion lamination device, a lower surface of the upper layer, and the blocking layer, which is an upper surface of the lower layer, in a state in which the thermal bonding resin layer is interposed between the upper layer and the blocking layer, and then applying pressure by using rollers of the extrusion lamination device.

9. The container sealing body of claim 1, wherein the upper layer comprises:

a surface layer, an intermediate base layer disposed below the surface layer and comprising a polyolefin-based film or a foamed polyolefin film or sheet, and an synthetic resin layer disposed below the intermediate base layer.

10. The container sealing body of claim 2, wherein a lower surface of the opening tab is embossed to reduce a contact area when the opening tab is laminated with the thermal bonding resin layer, such that the opening tab is easily separated from the lower layer.

11. The container sealing body of claim 2, wherein silicone is provided on the lower surface of the opening tab in order to improve releasability of a lower surface of the opening tab from the thermal bonding resin layer, such that the opening tab is prevented from being thermally bonded to an upper surface of the lower layer by the thermal bonding resin layer during a process of laminating the upper layer and the lower layer.

12. The container sealing body of claim 2, wherein a lower surface of the opening tab is embossed to reduce a contact area when the opening tab is laminated with the thermal bonding resin layer, such that the opening tab is easily separated from the lower layer, and wherein silicone is provided on the lower surface of the opening tab, which is embossed, in order to improve releasability of a lower surface of the opening tab from the thermal bonding resin layer, such that the opening tab is prevented from being thermally bonded to an upper surface of the lower layer by the thermal bonding resin layer during a process of laminating the upper layer and the lower layer.

13. The container sealing body of claim 12, wherein a thickness of the thermal bonding resin layer is 0.015 to 0.05 mm.

14. The container sealing body of claim 2, wherein the thermal bonding sealing layer is made of thermoplastic bonding resin which is configured to bond thermally to the container and is a seal to be clearly peeled and removed from the container when an opening of the container.

15. The container sealing body of claim 2, wherein the container is sealed with the thermal bonding sealing layer by induction heat seal when the blocking layer comprises the metal or the thin metal layer, or conduction heat seal when the blocking layer is the film layer.

16. A container sealing body applied to seal an inlet of a container, the container sealing body comprising:

an upper layer;

a lower layer provided below the upper layer; and a bonding resin layer configured between the upper layer and the lower layer and bonded by bonding resin, wherein an opening tab is at least a part of the upper layer, the opening tab being separable from the lower layer, wherein an opening initiation guide cutting line is formed at one side of the opening tab, wherein the opening initiation guide cutting line is configured to cut partially from the opening tab to an outermost circumferential edge line of the container sealing body, wherein the container sealing body overlaying a rim of the container defining the inlet, wherein when the opening tab is lifted away from the lower layer and pulled, the opening initiation guide cutting line is torn to the outermost circumferential edge line and the container sealing body is lifted from the rim with continued pulling of the opening tab to thereby peel the container sealing body completely from the rim to open the inlet of the container in use, and simultaneously peel a circumferential portion of the container sealing body overlaying a rim having a width completely from the rim, and wherein the opening tab connects to an outer peripheral portion of the container sealing body at a contact point, and the opening initiation guide cutting line is bonded to the lower layer and extends from the contact point to an edge point of the outermost circumferential edge line, and wherein the opening initiation guide cutting line is formed by a dotted line penetrating only the upper layer, and wherein the lower layer is intact and not cut below the opening initiation guide cutting line prior to opening.

17. The container sealing body of claim 16, wherein the upper layer comprises a surface layer comprising a polyester film or a polypropylene film.

18. The container sealing body of claim 16, wherein the upper layer comprises an intermediate base film comprising a polyolefin-based film or a foamed polyolefin film or sheet.

19. The container sealing body of claim 16, wherein the upper layer comprises a synthetic resin layer comprising a polyester film, a polypropylene film, or a polycarbonate film.

* * * * *